US008256199B2

(12) United States Patent
Schlagenhaft

(10) Patent No.: US 8,256,199 B2
(45) Date of Patent: Sep. 4, 2012

(54) METHOD FOR OPERATING A SPINDLE OF A TWO-FOR-ONE TWISTER OR CABLING MACHINE

(75) Inventor: Walter Schlagenhaft, Kempten (DE)

(73) Assignee: Oerlikon Textile GmbH & Co. KG., Remscheid (DE)

( * ) Notice: Subject to any disclaimer, the term of this patent is extended or adjusted under 35 U.S.C. 154(b) by 0 days.

(21) Appl. No.: 13/054,687

(22) PCT Filed: May 27, 2009

(86) PCT No.: PCT/EP2009/003760

§ 371 (c)(1), (2), (4) Date: Jan. 18, 2011

(87) PCT Pub. No.: WO2010/009786

PCT Pub. Date: Jan. 28, 2010

(65) Prior Publication Data

US 2011/0126506 A1 Jun. 2, 2011

(30) Foreign Application Priority Data

Jul. 19, 2008 (DE) ..... 10 2008 033 849

(51) Int. Cl.
*D01H 1/10* (2006.01)

(52) U.S. Cl. ..... 57/58.86; 57/264

(58) Field of Classification Search ..... 57/58.86, 57/264

See application file for complete search history.

(56) References Cited

U.S. PATENT DOCUMENTS

| | | | | |
|---|---|---|---|---|
| 3,950,927 | A * | 4/1976 | Kallman | 57/265 |
| 4,023,342 | A * | 5/1977 | Schenkel | 57/264 |
| 4,848,075 | A | 7/1989 | Frentzel-Beyme | |
| 5,535,579 | A * | 7/1996 | Berry et al. | 57/13 |
| 5,706,642 | A * | 1/1998 | Haselwander | 57/264 |
| 5,943,851 | A * | 8/1999 | Matas Gabalda et al. | 57/58.86 |
| 6,009,698 | A * | 1/2000 | Dinkelmann et al. | 57/75 |
| 7,104,483 | B2 * | 9/2006 | D'Agnolo | 242/155 R |

FOREIGN PATENT DOCUMENTS

| | | | |
|---|---|---|---|
| DE | 3708331 | C1 | 7/1988 |
| DE | 4121913 | A1 | 1/1992 |
| DE | 10030888 | A1 | 1/2002 |
| EP | 1167597 | A1 | 2/2004 |
| WO | 2010/009786 | A1 | 1/2010 |

* cited by examiner

*Primary Examiner* — Shaun R Hurley
(74) *Attorney, Agent, or Firm* — K&L Gates LLP

(57) ABSTRACT

A two-for-one twister or cabling machine and a method for operation thereof, wherein a yarn (5, 25) is withdrawn from a supply bobbin (7, 21) and fed to a guide device below a twisted yarn plate (8, 24) of the spindle (2, 22) and from which the yarn (5, 25) exits virtually perpendicular to the axis of the spindle (2, 22) and is deflected to the outer edge of the twisted yarn plate (8, 24) and runs along the spindle (2, 22) as a free yarn balloon (B) encompassing the spindle (2, 22), until the yarn (5, 25) is fed into the twist or cabling point of a yarn guide device (9, 27) above the spindle (2, 22). The supply speed of the yarn (5, 25) is adjusted to achieve a yarn tension which minimizes the yarn balloon diameter as a function of the spindle geometry.

12 Claims, 2 Drawing Sheets

METHOD FOR OPERATING A SPINDLE OF A TWO-FOR-ONE TWISTER OR CABLING MACHINE

CROSS-REFERENCE TO RELATED APPLICATIONS

This application claims the benefit of German patent application 10 2008 033 849.4, filed Jul. 19, 2008, and corresponding Patent Cooperation Treaty Application No. PCT/EP2009/003760, filed May 27, 2009, each herein incorporated by reference.

BACKGROUND OF THE INVENTION

The present invention relates to a method for operating a spindle of a two-for-one twister or cabling machine and a two-for-one twister or cabling machine for accomplishing such method.

It is known from German Patent Publication DE 41 21 913 A1 to influence the yarn tension of an inner yarn and an outer yarn on a cording spindle by means of adjusting mechanisms in such a way that the yarns are guided together at the cabling point at the same yarn tension and speed. In this case, the outer yarn is influenced by an outer yarn brake, the braking effect of which is controlled as a function of an inner yarn brake influencing the inner yarn. The outer yarn is introduced centrally into the cording spindle proceeding from the outer yarn brake and exits radially at a rotating storage disc, which is fastened below the twisted yarn plate on the cording spindle. The outer yarn winds round the storage disc here, at least partially, before the yarn is guided over the outer edge of the twisted yarn plate into the free yarn balloon.

The diameter of the storage disc and the twisted yarn plate, the balloon height from the arrangement of a balloon eyelet or a compensation system, which form the upper rotary point of the yarn balloon, the titre and the rotational speed of the spindle are to be mentioned as the variables which substantially influence the shape and the diameter of the free yarn balloon and the optimization of which, matched to one another, requires a very large outlay, which is often avoided. This is disadvantageous in that the balloon shape decisively also determines the energy consumption at each spindle but the influencing possibilities by means of the parameters mentioned are very small. Thus a reduction in the rotational speed of the spindle is accompanied by a loss in productivity. Furthermore, the yarn titre (yarn count) is based on the yarn material to be processed predetermined by the operator of the textile machine. It is only possible to influence the balloon height to a limited extent as components on the textile machine arranged further on in the yarn course limit the design scope.

A device for cabling is known from the generic European Patent Publication EP 1 167 597 B1, on which a storage disc below the twisted yarn plate to control the yarn tension is dispensed with. Instead, the yarn tension is substantially regulated by a pot which co-rotates with the spindle and substantially prevents the formation of a free yarn balloon except for a residual balloon. In this device, the influence of the storage disc compensating the yarn tension to compensate supply fluctuations is missing. Instead, the forced guidance of the yarn balloon takes place by means of the pot. Owing to the pot, the outer yarn rotating round the spindle is limited with respect to its radial extent, so the yarn tension is regulated on the basis of the friction of the outer yarn on the inner wall of the pot and this corresponds to the effect of using a storage disc. The free residual yarn balloon forming above the pot between the edge thereof and the yarn guide eyelet is not suitable to separate the yarn tension before and after the spindle in order to compensate influences in the supply. By using the co-rotating pot which is formed as a balloon limiter and absorbs the radial forces of the outer yarn, the yarn tension of the outer yarn is lower than in the cabling device known from German Patent Publication DE 41 21 913 A1 with a storage disc.

It proves to be disadvantageous in the cabling device known from European Patent Publication EP 1 167 597 B1 that the use of the pot which is subject to not inconsiderable wear owing to the rotating outer yarn, has to also be moved as a rotating mass by the spindle drive. In addition, the air friction of the pot causes additional losses that have to be compensated by the spindle drive. An achievable energy saving, which can be achieved by dispensing with the formation of the free yarn balloon is more than negated thereby.

SUMMARY OF THE INVENTION

The invention is based on the object of providing a method for operating a two-for-one twister or cabling machine, which is distinguished by reduced energy consumption, and proposing a two-for-one twister or cabling machine to carry out the method.

This object is achieved by a method for operating a spindle of a two-for-one twister or cabling machine, in which a yarn is withdrawn from a supply bobbin and fed to a guide device, which is arranged below a twisted yarn plate of the spindle (2, 22) and from which the yarn exits virtually perpendicular to the longitudinal axis of the spindle and is deflected to the outer edge of the twisted yarn plate and runs along the spindle as a free yarn balloon encompassing the spindle, until the yarn is fed into the twist or cabling point of a yarn guide device above the spindle. According to the method, the supply speed of the yarn is adjusted in such a way that the yarn tension adopts a value which minimizes the diameter of the free yarn balloon encompassing the spindle as a function of the geometry of the spindle.

The invention also provides a two-for-one twister or cabling machine comprising a plurality of workstations which each have a spindle driven by a spindle drive, a twisted yarn plate arranged below the spindle, on which plate a guide device for a yarn is arranged, from which the yarn exits substantially radially with respect to the spindle and forms a free yarn balloon around the spindle, until the yarn is fed into the twist or cabling point of a yarn guide device above the spindle. According to the invention, a controllable or regulatable device is connected upstream of the twisted yarn plate to influence the yarn tension, by means of which device the feed speed of the yarn is adjusted in such a way that the yarn tension of the yarn entering the guide device adopts a value, which minimizes the diameter of the free yarn balloon encompassing the spindle as a function of the geometry of the spindle.

Advantageous embodiments of the method and the machine according to the invention are described more fully hereinafter.

According to the present method, it is proposed that the feed speed of the yarn is adjusted in such a way that no storage is adjusted and that the yarn tension adopts a value which minimizes the diameter of the free yarn balloon encompassing the spindle as a function of the geometry of the spindle. The value of the yarn tension is adjusted according to the method of the invention in such a way that the yarn tension being adjusted becomes greater than the yarn tension adjusting itself during the use of a storage disc or due to the forced guidance of the yarn balloon in a pot. The principle, that the free yarn balloon has a pronounced, incontrovertible geometry, is breached by the method according to the invention, so that it needs no storage as in German Patent Publication DE 41 21 913 A1 or no forced guidance by a pot according to European Patent Publication EP 1 167 597 B1, which have the required compensating function in the twisting or cabling system. The increased yarn tension before entering the guide device leads to the fact that a different ejection angle is adjusted at the edge of the twisted yarn plate because of the reduced balloon diameter from the ejection angle, which is adjusted in the case of a tangential lifting of the yarn from a conventional spindle with a storage disc with the formation of a free yarn balloon or in the yarn balloon which is force-guided by the pot, which has the compensating function of the storage disc in a free yarn balloon. As the drive power is directly dependent on the balloon diameter, the reduction in the diameter of the free yarn balloon leads to the fact that the energy to be applied to form and maintain the rotation of the yarn balloon drops, so a saving in the energy consumption at the spindle of 20% to 30% can be achieved.

In this case, the yarn requirement at the twist or cabling point should be constantly determined and the feed speed of the yarn adapted to the determined yarn requirement. By continuously adapting the feed speed, fluctuations in the supply of the yarn, which can lead to a break of the yarn or to a collapse of the yarn balloon, are avoided.

The yarn tension, which is determined before or after the formation of the yarn balloon at the spindle, can preferably be used as a control variable for the feed speed.

The power consumption of a spindle drive being used to drive the spindle can alternatively be used as a control variable for the feed speed. As already stated, the feed speed influences the diameter of the free yarn balloon, the dimension of which is decisive for the power consumption of the spindle drive, which is in turn easy to detect and to regulate.

The diameter of the free yarn balloon can likewise be used as the control variable for the feed speed. Any combination of the control variables mentioned is also conceivable to regulate the feed speed as precisely as possible.

In this case, the yarn tension or the power consumption is easier to determine compared to determining the diameter of the free yarn balloon. A combination of a plurality of the control variables mentioned may also be sensible in order to adhere to the required value for the feed speed to minimize the yarn balloon.

The required monitoring of the control variable may preferably be carried out electronically and/or mechanically.

The two-for-one twister or cabling machine is proposed to carry out the method, characterized in that a controllable or regulatable device is connected upstream of the twisted yarn plate to influence the yarn tension, by means of which device the feed speed of the yarn is adjusted in such a way that the yarn tension of the yarn entering the feed device adopts a value which minimizes the diameter of the free yarn balloon encompassing the spindle as a function of the geometry of the spindle. The yarn fed to the feed device is loaded by the controllable or regulatable device connected upstream of the spindle drive to influence the yarn tension with a yarn tension in order to minimize the free yarn balloon being formed, which has a direct positive influence on the energy consumption of the spindle drive.

A control mechanism should be provided for this purpose, which is set up to control or regulate the device as a function of one or more control variables.

The device may, in particular, be an active delivery mechanism.

Alternatively, the device can be configured as a brake or as a combination of a brake and active delivery mechanism.

A godet, a trailing fan disc or a pressure roller may be provided as configuration variants of the delivery mechanism.

BRIEF DESCRIPTION OF THE DRAWINGS

The invention will be described in more detail below with the aid of embodiments shown in the drawings, in which.

DETAILED DESCRIPTION OF THE PREFERRED EMBODIMENTS

Figure 1:
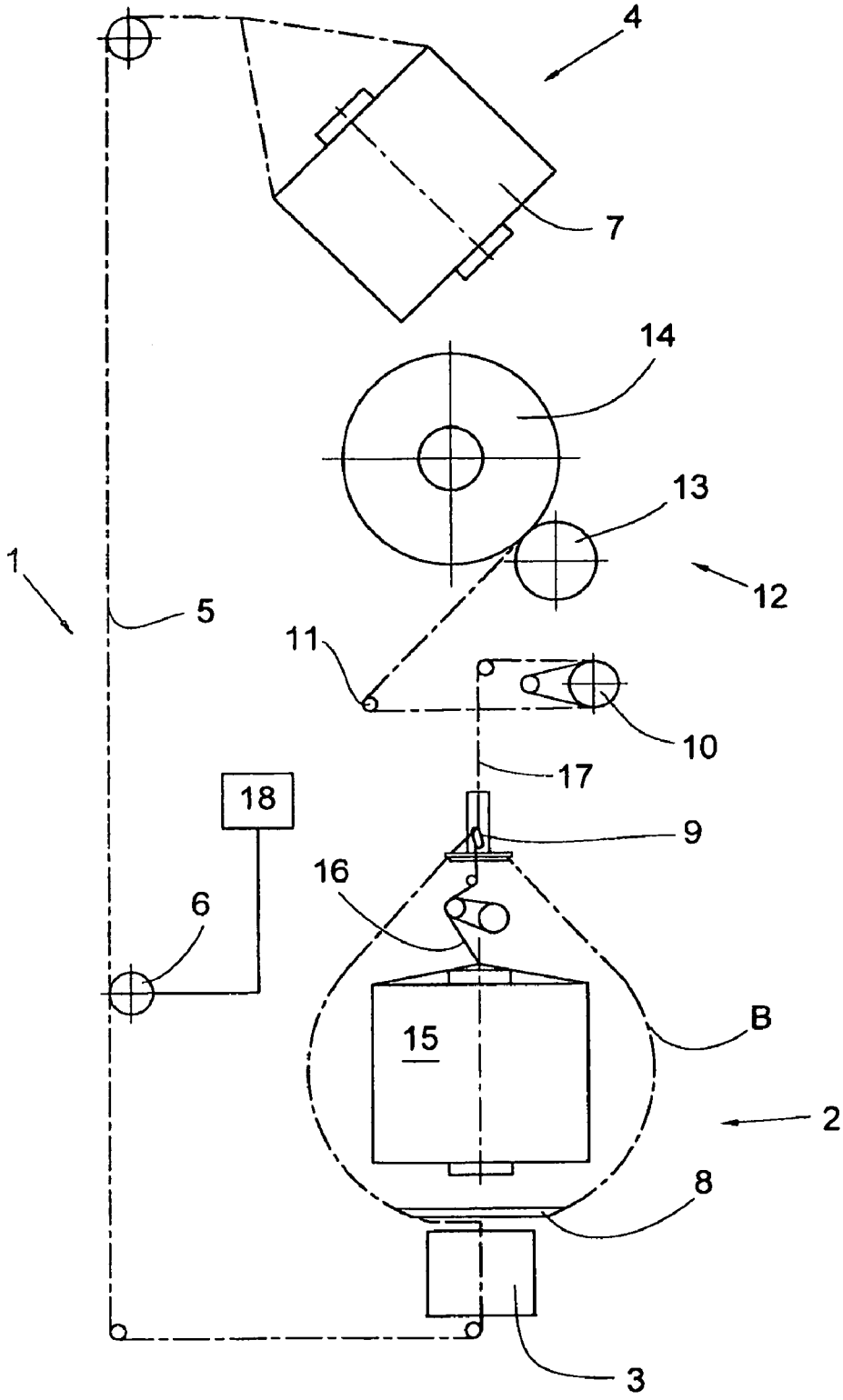
FIG. 1 shows a schematised view of a workstation of a cabling machine.

FIG. 1 shows a schematic view of the structure of a workstation 1 of a cabling machine, with the aid of which the method according to the invention is described. The workstation 1 has a creel 4, which is used to receive at least a first supply bobbin 7, from which a so-called outer yarn 5 is drawn. Furthermore, the workstation 1 comprises a cabling spindle 2, which is driven by a spindle drive 3. The spindle drive 3 may be a motor which directly drives the cabling spindle 2 or an indirect drive, for example a belt drive. The cabling spindle 2 carries, on a twisted yarn plate 8 arranged on the cabling spindle 2, a second supply bobbin 15, from which a so-called inner yarn 16 is withdrawn overhead, which is supplied above the cabling spindle 2 to a balloon eyelet or a compensation system 9, in the present embodiment, a cord regulator.

The outer yarn 5 withdrawn from the first supply bobbin 7 is fed to a regulatable yarn tension influencing device 6 arranged between the creel 4 and the cabling spindle 2 in the yarn course, by means of which device the yarn tension is varied. For this purpose, the yarn tension influencing device 6 is connected to a control mechanism 18, which carries out the regulation of the yarn tension applied by the device 6. The yarn tensioning influencing device 6 is connected upstream of the twisted yarn plate 8, viewed in the yarn withdrawal direction. The outer yarn 5 then runs through the spindle drive 3 in the rotational axis, and exits the spindle drive 3 below the twisted yarn plate 8. The outer yarn 5 is deflected by means of a deflection tangential to the twisted yarn plate 8 and runs up to the outer edge of the twisted yarn plate 8. The outer yarn 5 is deflected upward at the edge of the twisted yarn plate 8 so that the outer yarn 5 runs round the supply bobbin 15 along the cabling spindle 2 with the formation of a free yarn balloon B. The balloon eyelet or the compensation system 9 in which the outer yarn 5 withdrawn from the first supply bobbin 7 and the inner yarn 16 withdrawn from the second supply bobbin 15 are guided together, determines the height of the free yarn balloon B being formed. Located in the balloon eyelet or the compensation system 9 is the cabling or else cording point in which the two yarns 5, 16 run together and form the cord yarn 17.

A withdrawal device 10 is arranged above the cabling point, by means of which the cord yarn 17 is withdrawn and is fed by means of a compensation element, such as, for example, a dancer 11, to a winding device 12. The winding device 12 has a drive roller 13 and a bobbin 14 driven by means of frictional engagement by the drive roller 13.

The yarn tension influencing device 6 has the task of varying the yarn tension of the outer yarn 5 in front of the twisted yarn plate 8, in particular to increase it, in such a way that a storage disc, the use of which is usual to compensate irregularities in the yarn feed in general, becomes dispensable. The regulatable yarn tension applied to the outer yarn 5 has an order of magnitude which, as a function of the geometry of the spindle 2, leads to a minimisation of the free yarn balloon B. This is achieved by a changed ejection geometry of the outer yarn 5, which is produced from dispensing with the storage. While, when using a storage disc, the outer yarn lifts tangentially therefrom after winding around it, at least partially, a different ejection angle of the outer yarn 5 is adjusted owing to dispensing with the use of the storage disc, because of the increased yarn tension at the outer edge of the twisted yarn plate 8, so the diameter of the free yarn balloon B being formed is minimized. Yarn storage is not provided or present in the method according to the invention or the device according to the invention in normal operation.

An electronically controlled brake or an active delivery mechanism or a combination of the two components may be used, for example, as the yarn tension influencing device 6. A godet, a fan disc or a roller with a corresponding pressure roller are possible, for example, as configuration variants of the delivery mechanism. Important to the invention is the active, regulatable influencing of the yarn tension in order to maintain the free yarn balloon B with an, as far as possible constant, minimized diameter. The control device 18 associated with the yarn tension influencing device 6 for this purpose preferably uses the tension of the outer yarn 5 before or after the formation of the free yarn balloon B, as the control variable. The diameter of the yarn balloon B or the power consumption of the spindle drive 3 may alternatively or additionally also be used as the control variable in order to be able to directly compensate fluctuations in the delivery speeds, which lead to changes in the yarn tension.

The monitoring of the yarn tension to regulate the yarn tension influencing device 6 may be carried out electronically and/or mechanically, for example by a dancer roller or a conical roller. When using a dancer roller, which is connected to the outer yarn 5, the deflection thereof because of the changing yarn tension is detected and is used as the control variable for that of the yarn tension influencing device 6.

Figure 2:
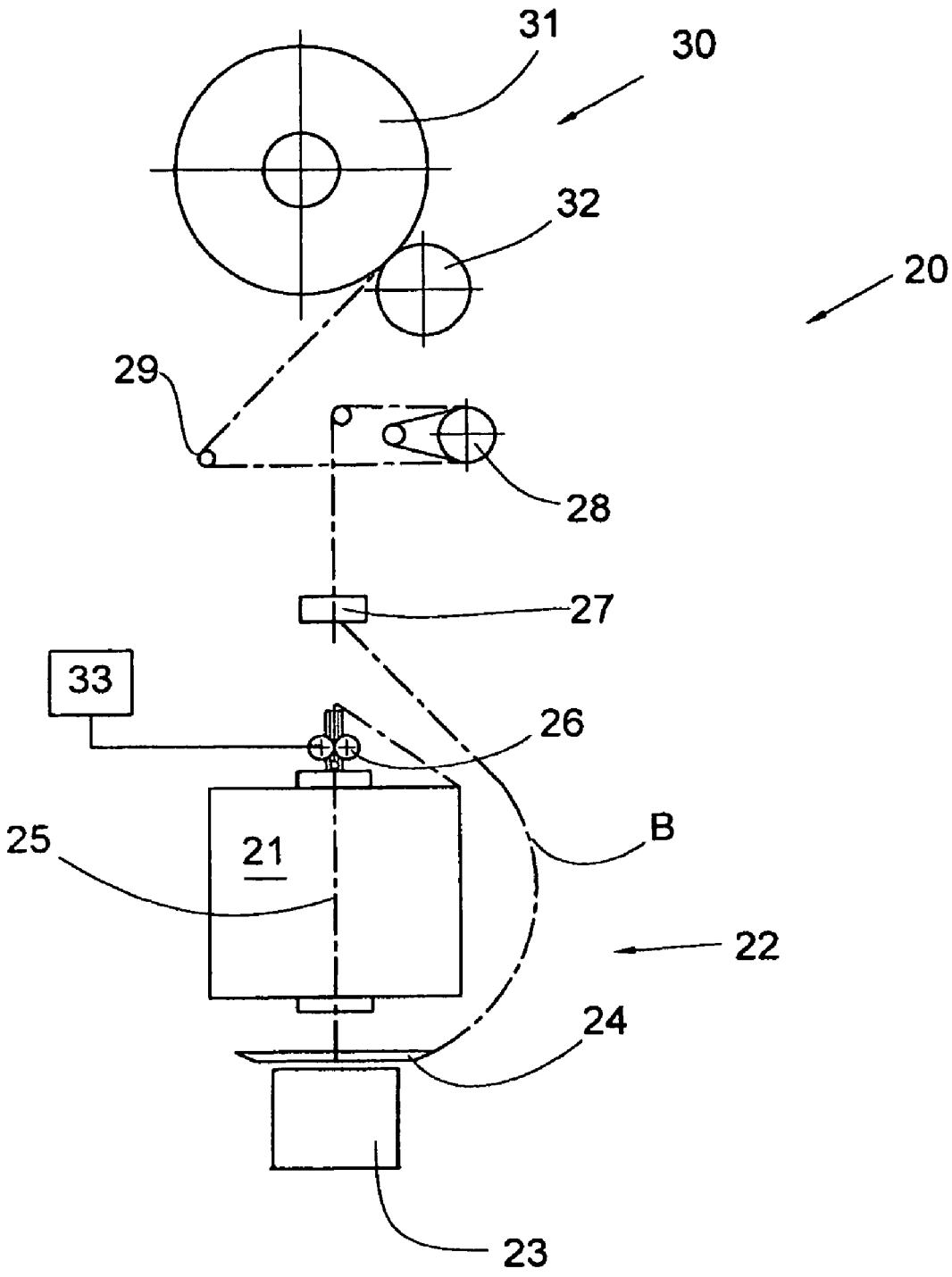
FIG. 2 shows a schematised view of a workstation of a two-for-one twister.

FIG. 2 shows a schematic view of the structure of a workstation 20 of a two-for-one twister, which works according to the method of the invention. The workstation 20 has a twisting spindle 22, which is driven by a spindle drive 23. A supply bobbin 21, from which a yarn 25 is withdrawn and supplied to a yarn tension influencing device 26, is located on the twisting spindle 22. The yarn tension influencing device 26 is regulated by a control device 33 in a manner already described for the cabling machine. The arrangement of the yarn tension influencing device 26 in the yarn course is such that the latter is situated upstream of the twisted yarn plate 24 in the yarn withdrawal direction. The yarn 25 is guided through the twisting spindle 22 configured as a hollow spindle and exits below a twisted yarn plate 24 carrying the supply bobbin 21. The yarn 25 is guided to the edge of the twisted yarn plate 24, where it is deflected and runs round the twisting spindle 22 with the formation of a free yarn balloon B. The yarn 25 is fed to a balloon eyelet 27, which limits the height of the free yarn balloon B. A yarn withdrawal device 28 is provided above the balloon eyelet 27. In the further yarn course, a compensation element 29 is connected downstream of the yarn withdrawal device 28, as well as a winding device 30 with a drive roller 32 and a bobbin 31 driven by the drive roller 32 by frictional engagement.

What is claimed is:

1. Method for operating a spindle (2, 22) of a two-for-one twister or cabling machine, in which a yarn (5, 25) is withdrawn from a supply bobbin (7, 21) and fed to a guide device, which is arranged below a twisted yarn plate (8, 24) of the spindle (2, 22) and from which the yarn (5, 25) exits virtually perpendicular to the longitudinal axis of the spindle (2, 22) and is deflected to the outer edge of the twisted yarn plate (8, 24) and runs along the spindle (2, 22) as a free yarn balloon (B) encompassing the spindle (2, 22), until the yarn (5, 25) is fed into the twist or cabling point of a yarn guide device (9, 27) above the spindle (2, 22), characterized in that the supply speed of the yarn (5, 25) is adjusted by a yarn tension influencing device (6, 26), without a yarn storage means, for varying the yarn tension according to a determined yarn requirement which produces a modified discharge geometry of the yarn and minimizes the diameter of the free yarn balloon (B) encompassing the spindle (2, 22) as a function of the geometry of the spindle (2, 22).

2. Method according to claim 1, characterized in that the yarn requirement is constantly determined at the twist or cabling point and in that the supply speed of the yarn (5, 25) is adapted to the determined yarn requirement.

3. Method according to claim 1, characterized in that the yarn tension, which is determined before or after the formation of the yarn balloon (B) at the spindle (2, 22), is used as a control variable for adjusting the supply speed.

4. Method according to claim 1, characterized in that the power consumption of a spindle drive (3, 23) being used to drive the spindle (5, 25) is used as a control variable for adjusting the supply speed.

5. Method according to claim 1, characterized in that the diameter of the free yarn balloon (B) is used as a control variable for adjusting the supply speed.

6. Method according to claim 3, 4 or 5, characterized by monitoring of the control variable electronically.

7. Method according to claim 3, 4 or 5, characterized by monitoring of the control variable mechanically.

8. Two-for-one twister or cabling machine comprising a plurality of workstations (1, 20) which each have a spindle (2, 22) driven by a spindle drive (3, 23), a twisted yarn plate (8, 24) arranged below the spindle (2, 22), on which plate a guide device for a yarn (5, 25) is arranged, from which the yarn (5, 25) exits substantially radially with respect to the spindle (2, 22) and forms a free yarn balloon (B) around the spindle (2, 22), until the yarn (5, 25) is fed into the twist or cabling point of a yarn guide device (9, 26) above the spindle, characterized in that a controllable or regulatable yarn tension influencing device (6, 26), without a yarn storage means, is connected upstream of the twisted yarn plate (8, 24) to influence the yarn tension, by means of which device the supply speed of the yarn (5, 25) is adjusted for varying the yarn tension of the yarn (5, 25) entering the guide device according to a determined yarn requirement, which produces a modified discharge geometry of the yarn and minimizes the diameter of the free yarn balloon (B) encompassing the spindle (2, 22) as a function of the geometry of the spindle (2, 22).

9. Two-for-one twister or cabling machine according to claim 8, characterized in that a control mechanism (18, 33) is provided, which is set up to control or regulate the device (6, 26) as a function of one or more control variables to influence the yarn tension.

10. Two-for-one twister or cabling machine according to claim 8, characterized in that the device (6, 26) for influencing the yarn tension is an active delivery mechanism.

11. Two-for-one twister or cabling machine according to claim 8, characterized in that the device (6, 26) for influencing the yarn tension is a brake.

12. Two-for-one twister or cabling machine according to claim 8, characterized in that the device (6, 26) for influencing the yarn tension is a godet.

* * * * *